US005817447A

United States Patent [19]

Yip

[11] Patent Number: 5,817,447

[45] Date of Patent: Oct. 6, 1998

[54] LASER FILM PRINTER WITH REDUCED FRINGING

[75] Inventor: Kwok Leung Yip, Webster, N.Y.

[73] Assignee: Eastman Kodak Company, Rochester, N.Y.

[21] Appl. No.: 681,004

[22] Filed: Jul. 22, 1996

Related U.S. Application Data

[60] Provisional application No. 60/007,057 Nov. 8, 1995.

[51] Int. Cl.[6] ..... G03C 5/08; G03C 27/72

[52] U.S. Cl. ..... 430/363; 430/508; 430/945; 430/567; 347/225; 347/112; 347/262

[58] Field of Search ..... 430/363, 508, 430/945, 567; 347/225, 112, 262

[56] References Cited

U.S. PATENT DOCUMENTS 4,711,838 12/1987 Grzeskowiak et al. ..... 430/568
4,770,978 9/1988 Matsuzaka et al. ..... 430/363
4,954,429 9/1990 Urata ..... 430/503
5,466,564 11/1995 Blazey et al. ..... 430/403

*Primary Examiner*—Mark F. Huff
*Attorney, Agent, or Firm*—William F. Noval

[57] ABSTRACT

A laser film printer system comprising:

a source of a beam of light having a wavelength in the blue or ultraviolet region;

a modulator for modulating the beam of light according to an input image signal;

a monochrome film having a photosensitive layer which is sensitive to light in the blue or ultraviolet region; and a scanner for scanning the film with the beam of light to form an image therein representative of the input image signal;

wherein the wavelength of the source of a beam of light and the grain size and coating density of the silver halide in the photosensitive layer of the monochrome film are chosen to eliminate interference fringes of said film image.

11 Claims, 3 Drawing Sheets

LASER FILM PRINTER WITH REDUCED FRINGING

CROSS REFERENCE TO RELATED APPLICATION

Reference is made to and priority claimed from U.S. Provisional application Ser. No. 60/007,057, filed 08 Nov. 1995, entitled LASER FILM PRINTER WITH REDUCED FRINGING.

FIELD OF THE INVENTION

This invention relates in general to a laser film printer and relates more particularly to a medical laser film printer using blue or ultraviolet laser light to eliminate interference fringing in the printed film.

BACKGROUND OF THE INVENTION

Medical laser film printers have been an important component for various digital medical imaging modalities [such as ultrasound (US), computerized tomography (CT), magnetic resonance imaging (MRI), and computed radiography (CR)], as well as for picture archiving and communication systems (PACS). They provide high-quality hard-copy images on film. The types of lasers used in available medical laser film printers are either an infrared (IR) semiconductor laser diode or a helium-neon (HeNe) gas laser with wavelength ranging from 632.8 nm to 820 nm. Lasers now used include a laser diode with a wavelength of 820 nm, a HeNe gas laser with a wavelength of 632.8 nm, and a laser diode with a wavelength of 670 nm.

One of the typical image artifacts in laser-film printing is the appearance of interference fringes on uniformly exposed and processed images. These fringe patterns, which look similar to the interference patterns associated with Newton's rings, result from coherent interference of the incident laser light with the laser light specularly reflected from the back surface of the film. Visibility of these fringes is closely correlated with the specular density of the unprocessed film. In general, film images produced by the printers using infrared or red lasers do not show any interference fringes when the total specular density of the unprocessed film at the laser's wavelength is higher than 1.80. The specular density of a film depends upon the scattering efficiency of the silver halide (AgX) grains in the emulsion layer and the amount of anti-halation dye in the pelloid layer. To eliminate the interference fringes, relatively large AgX grain size and grain coverage are usually used in the emulsion layer. Examples of currently available films used in medical laser film printers, include a film which has 270 mg/ft$^2$ of 0.25 $\mu$m AgBr grains and 220 mg/ft$^2$ of 0.38 $\mu$m AgBr grains, and a film which has 184 mg/ft$^2$ of 0.2 $\mu$m AgBr grains, 46 mg/ft$^2$ of 0.4 $\mu$m AgBr grains, and 5 mg/ft$^2$ of anti-halation dye coated in the pelloid layer.

In order to achieve high-quality images printed on low-cost film, it is desirable to reduce the grain size of silver halide particles and the coating weight of silver halide in the emulsion layer of the film. However, if the same range of laser wavelength (632.8 nm–820 nm) is used, a problem arises because the reduction of grain size and silver halide coverage would produce visible interference artifacts in the images.

SUMMARY OF THE INVENTION

According to the present invention there is provided a solution to the aforementioned problems of available medical laser printers.

According to a feature of the present invention, there is provided a laser film printer system comprising:

a source of a beam of light having a wavelength in the blue or ultraviolet region;

a modulator for modulating said beam of light according to an input image signal;

a monochrome film which is sensitive to light in the blue or ultraviolet region;

a scanner for scanning said film with said beam of light to form an image therein representative of said input image signal;

wherein the wavelength of said source of a beam of light and the grain size and coating density of the photosensitive layer of said monochrome film are chosen to eliminate interference fringes of said film image.

The present invention has the following advantages.

1. Smaller AgX grains and less dense AgX coating can be used to achieve no visible fringes in the printed image.
2. The use of smaller AgX grains results in higher covering power, lower silver halide coating weight and thus lower silver cost, shorter cycle time for processing, lower replenishing rate of developer, lower granularity, higher contrast, higher resolution, higher modulation transfer function (MTF) and sharper image.

DESCRIPTION OF THE PREFERRED EMBODIMENTS

Figure 1:
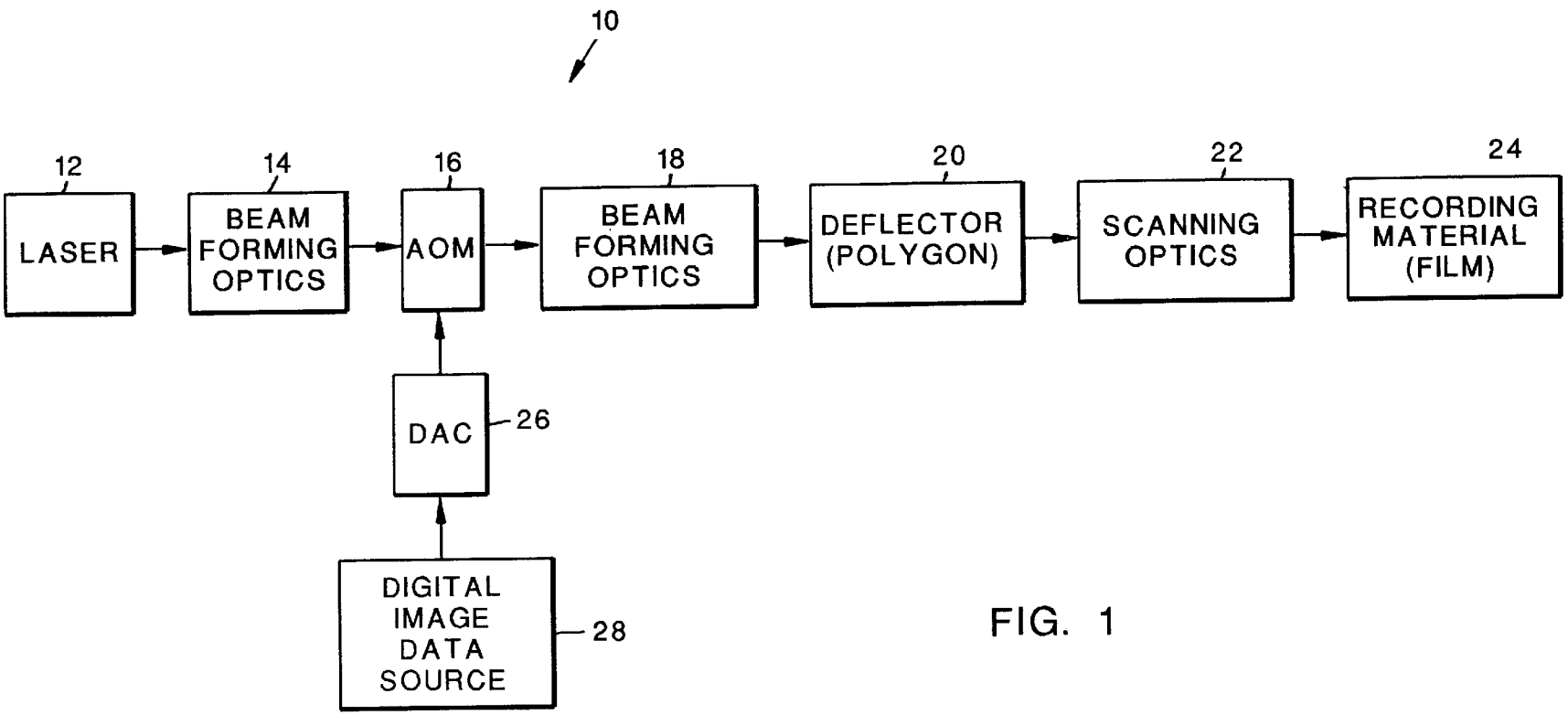
FIG. 1 is a block diagram of a medical laser printer system incorporating the present invention.

Referring now to FIG. 1, there is shown a block diagram of a medical laser printer system incorporating an embodiment of the present invention. As shown, printer system 10 includes a source 12 of a beam of light, such as a laser, which has a wavelength in the blue or ultraviolet region. Beam forming optics 14 forms the light beam into a desired shape. A digital image data source 28 provides an input image signal which is converted to an analog signal by digital-to-analog converter (DAC) 26. The analog image signal is applied to acousto-optic modulator (AOM) 16 which modulates the light beam from optics 14. The modulated light beam is further shaped by beam forming optics 18, and scanned onto recording material 24 by deflector 20 and scanning optics 22.

Instead of AOM 16, the laser 12 may be directly modulated by controlling the drive current to the laser diode by means of the image signal.

The light source 12 may be one of many suitable types as follows: 1) a frequency doubled semiconductor laser diode with nonlinear optic materials (e.g., use of a GaAlAs laser diode with a ring resonator of $KNbO_3$ yields 41 mW output power at 428 nm); 2) direct-emission laser diodes using II–VI compounds (like ZnSe) or GaN based III–V nitrides emit blue/UV light; 3) tunable dye lasers and gas lasers (e.g., Ar and HeCd) provide high power at blue and UV wavelengths; 4) excimer lasers provide highly efficient and powerful UV laser sources (Commercial excimer lasers operate at a number of wavelengths depending on the gas mixture used. Rare-gas halides are the best known mixtures and provide outputs at the following wavelengths: ArF-193 nm, KrF-248 nm, XeCl-308 nm, and XeF-351 nm); 5) organic LED arrays and GaN LEDs with a wavelength of 45 nm could be other sources for blue light.

Figure 2:
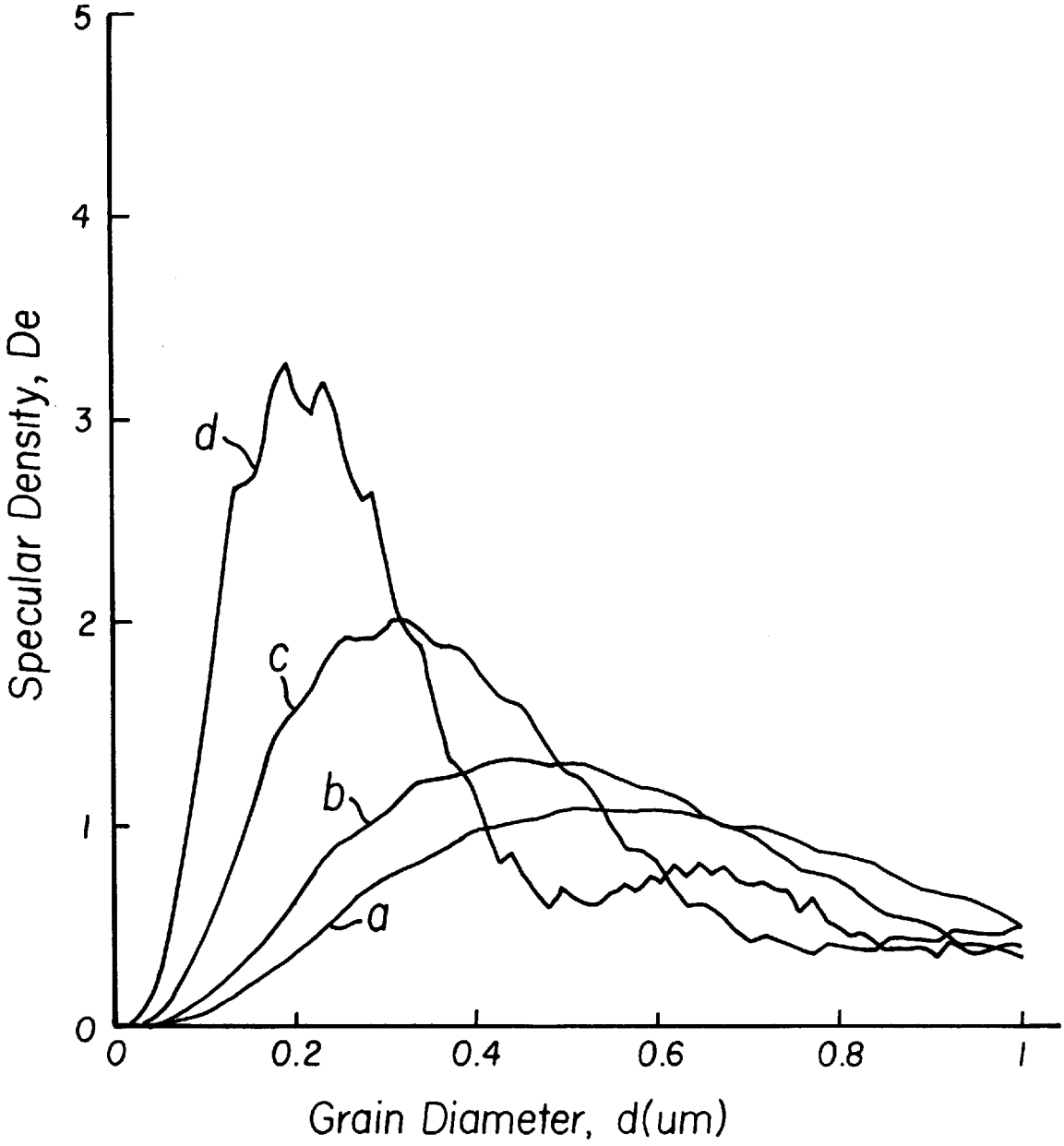
FIGS. 2 and 3 are graphical views showing plots of specular density versus grain size which are useful in explaining the present invention.
Figure 3:
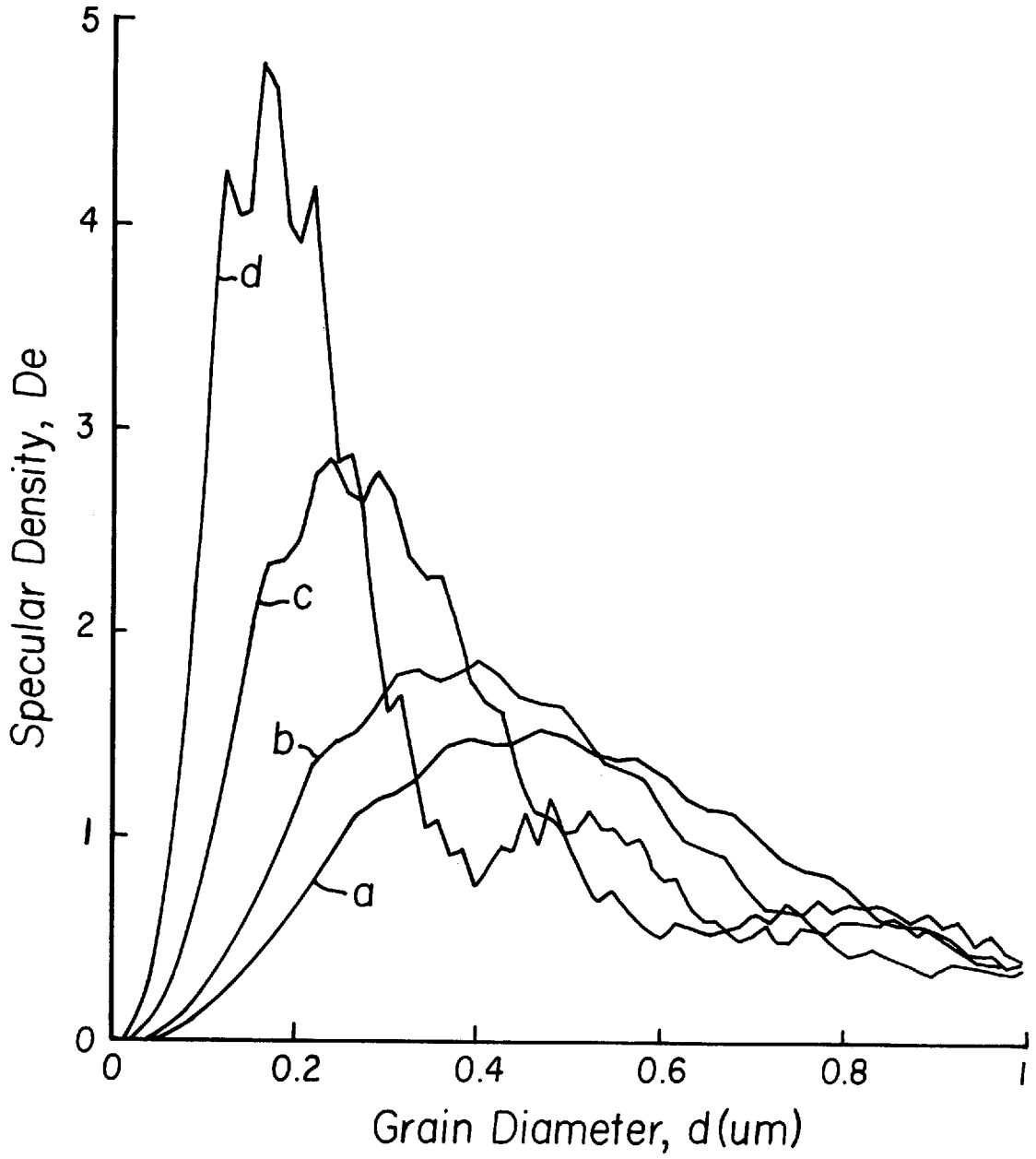

The effect of using a blue or UV laser for laser film printing on film design (AgX grain size and AgX coverage) is shown in FIGS. 2 and 3. Shown are graphical illustrations of specular density De of the unprocessed AgX emulsion layer per 100 mg/ft$^2$ silver laydown as a function of grain diameter d at various laser wavelengths. It is noted that the specular density of the emulsion scales with the silver coverage. The specular density of unprocessed AgX emulsion is calculated by using the Mie theory. In the Mie calculation, the edge length of the cubic AgX grains is used as the equivalent spherical diameter of the grains, giving the best overall agreement between calculated specular densities and measured specular densities (with a mean density error less than 0.12) for ninety five experimental film coatings. FIGS. 2 and 3 show the results for the $AgCl_{0.7}$ $Br_{0.3}$ and AgBr emulsions, respectively.

As pointed out above, a film generally does not show interference fringes when the specular density at the laser's wavelength is higher than 1.8. In FIG. 2, showing the results for the $AgCl_{0.7}$ $Br_{0.3}$ emulsion with 100 mg/ft$^2$ silver laydown, plots a and b for 633 nm laser and 543 nm lasers show insufficient peak specular density to prevent interference fringes. Plots c and d for 420 nm and 340 nm lasers, however, show peaks at d=0.33 $\mu$m and d=0.19 $\mu$m, respectively, above the required specular density to eliminate interference fringes. It is thus clear that one can use a significantly smaller grain size and less silver halide coverage if a laser of lower wavelength is used. As shown in FIG. 2, for example, according to the present invention, interference fringes in the printed image may be eliminated by using a laser having a wavelength of 340 nm in combination with a film having an emulsion coating with 0.1 $\mu$m size (edge length) grains of $AgCl_{0.7}Br_{0.3}$ with 100 mg/ft$^2$ silver laydown. As a second example according to the present invention, interference fringes in the printed image may be eliminated by using a laser having a wavelength of 420 nm in combination with a film having an emulsion coating of 0.2 $\mu$m size grains of $AgCl_{0.7}Br_{0.3}$ with 100 mg/ft$^2$ silver laydown coupled with a pelloid layer having a specular density of about 0.3.

Results for the AgBr emulsion are shown in FIG. 3. For example, according to the present invention, interference fringes in the printed image may be eliminated by using a laser having a wavelength of 340 nm in combination with a film having an emulsion coating with a 0.1 $\mu$m size grains of AgBr with 75 mg/ft$^2$ silver laydown. As another example according to the present invention, interference fringes in the printed image may be eliminated by using a laser having a wavelength of 420 nm in combination with a film having an emulsion coating of 0.2 $\mu$m size grains of AgBr with 75 mg/ft$^2$ silver laydown.

Compared with the currently available films used in medical laser film printers, the grain size and coating density of the AgX films used in the present invention are significantly smaller. Similar design for films using other type of AgX grains (such as AgCl) or combination of different AgX grains can be obtained by following the above procedure.

Although the use of smaller AgX grain size can result in a reduction in film speed, this can be compensated for by increasing the laser power and using efficient sensitizing dyes for the blue or UV light.

Although the invention has been described with reference to preferred embodiments thereof, it will be understood that variations and modifications can be effected within the spirit and scope of the invention.

What is claimed is:

1. A laser film printer system comprising:

a source of a beam of light having a wavelength only in the blue or ultraviolet region;

a modulator for modulating said beam of light according to a monochrome input image signal;

a monochrome film having a photosensitive silver halide layer which is only sensitive to light in the blue or ultraviolet region; and a scanner for scanning said film with said beam of light to form an image therein representative of said input image signal;

wherein the wavelength of said source of a beam of light and the grain size and coating density of the photosensitive layer of said monochrome film are chosen such that the specular density of the unprocessed film at the laser's wavelength is higher than 1.8 to eliminate interference fringes of said film image.

2. The system of claim 1 wherein said source of a beam of light is a laser having a wavelength of less than 460 nm.

3. The system of claim 2 wherein said laser is one of the following:

a frequency-doubled laser diode;

a direct-emission laser diode using II–VI compounds or GaN based III–V nitrides that emit in the blue and UV wavelength regions;

a tunable dye laser and gas laser which emit in the blue and UV wavelength regions;

an excimer laser which emits in the blue and UV wavelength regions;

an LED or an LED array which emits in the blue and UV wavelength regions.

4. The system of claim 1 wherein said modulator is an acousto-optic modulator which modulates said beam of light as a function of said input image signal.

5. The system of claim 1 wherein said modulator is a circuit for directly modulating said source of a beam of light as a function of said input image signal.

6. The system of claim 1 wherein said monochrome film contains sensitizing dyes appropriate for the wavelength of the source of a beam of light.

7. The system of claim 1 wherein said monochrome film includes a photosensitive layer of silver halide grains having a size (edge length) less than 0.3 $\mu$m and of a coating concentration which eliminates interference fringes in the image formed in said film.

8. The system of claim 1 wherein said source of a beam of light has a wavelength of 340 nm and wherein said monochrome film includes a photosensitive layer of $AgCl_{0.7}Br_{0.3}$ grains having a size (edge length) of 0.1 to 0.3 $\mu$m with a silver laydown density of 100 mg/ft$^2$.

9. The system of claim 1 wherein said source of a beam of light has a wavelength of 420 nm and wherein said monochrome film includes a photosensitive layer of $AgCl_{0.7}Br_{0.3}$ grains having a size (edge length) of 0.25–0.3 $\mu$m with a silver laydown density of 100 mg/ft$^2$.

10. The system of claim 1 wherein said source of a beam of light has a wavelength of 340 nm and wherein said monochrome film includes a photosensitive layer of AgBr grains having a size of 0.1 to 0.28 $\mu$m with a silver laydown density of 75 mg/ft$^2$.

11. The system of claim 1 wherein said source of a beam of light has a wavelength of 420 nm and wherein said monochrome film includes a photosensitive layer of AgBr grains having a size of 0.2 to 0.3 $\mu$m with a silver laydown density of 75 mg/ft$^2$.

* * * * *